United States Patent [19]

Ibarzabal

[11] 4,344,529

[45] Aug. 17, 1982

[54] COMBINED SOAP HOLDER AND PRESS

[76] Inventor: Joe A. Ibarzabal, 15546 Chase St., #18, Sepulveda, Calif. 91343

[21] Appl. No.: 225,869

[22] Filed: Jan. 19, 1981

[51] Int. Cl.[3] ..... A47K 5/08

[52] U.S. Cl. ..... 206/77.1; 425/409; 425/410; 249/66 R; 249/170

[58] Field of Search ..... 206/77.1; 248/311.1; 425/84, 318, 394, 395, 406, 408, 409, 410; 249/66 R, 67, 68, 160, 170

[56] References Cited

U.S. PATENT DOCUMENTS

| | | | |
|---|---|---|---|
| 1,785,797 | 12/1930 | Watson | 425/409 X |
| 2,930,160 | 3/1960 | Pohl | 206/77.1 |
| 4,035,122 | 7/1977 | Cavanaugh | 425/410 X |
| 4,133,443 | 1/1979 | Medina et al. | 206/77.1 X |
| 4,313,537 | 2/1982 | Collet | 206/77.1 |

*Primary Examiner*—Steven M. Pollard
*Attorney, Agent, or Firm*—Roger A. Marrs

[57] ABSTRACT

A combined soap holder and press is disclosed herein for use in saving soap pieces by reforming remnants with a new soap bar of usable size which includes a base dish for holding a soap bar and a lid hingably carried on one end of the dish adapted to cover the soap bar and soap remnants. A cam, pivotally carried on the other end of the dish, operates on the exterior of the lid to compress the soap contents of the dish. Drainage apertures are provided in the lid and the dish and one end of the dish includes an outwardly projecting or cantilevered arm for supporting the lid on a soap holder when used as a press. The lid includes a parting bar movably carried thereon for breaking soap away after a pressing procedure.

10 Claims, 5 Drawing Figures

COMBINED SOAP HOLDER AND PRESS

BACKGROUND OF THE INVENTION

1. Field of the Invention

The present invention relates to devices for holding soap and for combining soap pieces with a new bar of soap and more particularly to a novel combined soap holder and press which employs a semi-circular cam pivotally carried on one end of the holder for forcibly urging a lid against the soap contents of a supporting dish.

2. Brief Description of the Prior Art

In the past, full use of a bar of soap is rarely achieved since as the bar is used, it becomes increasingly thinner and finally breaks into two or more remnants. Due to the difficulty in using such remnants for bathing and toilet purposes, the remnants are normally discarded even though they include a substantial volume or quantity of soap material. Due to the cost of soap products, it is advantageous that these remnants be re-combined with a new bar of soap so that they will become useful for washing purposes.

Several attempts have been made to employ devices which combine soap remnants but difficulties have been encountered when attempting to combine soap remnants with a new bar of soap. Such difficulties usually stem from the fact that the soap holder is of insufficient volume to carry both remnants and a new bar of soap and the means for compressing the soap remnants with the new bar are insufficient to achieve adhesion therebetween. Rather crude presses have been employed which have attempted to use rotating or screw type mechanisms for compacting soap remnants while other devices have merely suggested hand pressing a lid against the soap remnants held by a dish. Although some compaction is achieved, it is difficult to release or part the soap from the dish after compaction and a substantial amount of water still remains in the device.

Therefore, a long standing need has existed for a soap holder and press combination which will readily compress soap remnants into a new soap cake employing a mechanical press means for assuring adhesion between the remnants and the soap cake and which will provide proper drainage and a parting or separating means for breaking the compressed soap cake away from the device.

SUMMARY OF THE INVENTION

Accordingly, the above problems and difficulties are obviated by the present invention which provides a novel combined soap holder and press which include a base dish for holding a cake of soap and a plurality of soap remnants. A lid is hingably carried on one end of the dish so as to cover the soap cake and remnants while a cam means is pivotally carried on the opposite end of the dish for forcibly urging the lid into contact with the soap remnants and soap cake so as to press the latter against the dish. Drainage means are provided in both the lid and the dish for permitting excess water to escape and a parting means is movably carried on the lid for manually separating the combined soap remnants and cake from the inside surface of the lid.

Means are provided for supporting the lid adjacent to the dish so as to provide an additional soap holder when the lid is not employed as a press.

Therefore, it is among the primary objects of the present invention to provide an inexpensive soap holder and press in which remnants of soap may be placed on top of a new soap cake and manually subjected to compression to the extent that they are reformed into a bar of soap of desired configuration.

Another object of the present invention is to provide a novel combined soap holder or dish and press which will promote the saving and utilization of soap remnants which heretofore have been discarded as useless.

Still another object of the present invention is to provide a novel combined soap holder and press having means for separating or breaking the combined soap cake away from the device after compaction and which provides drainage holes for permitting water and other fluids to escape therefrom.

Yet another object of the present invention is to provide a novel combined soap holder and press wherein the dish of the combination serves as a holder and the lid of the combination serves as a holder and means are carried on the dish for supporting the lid in a side-by-side relationship.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description taken in connection with the accompanying drawings, in which:

DESCRIPTION OF PREFERRED EMBODIMENT

Figure 1:
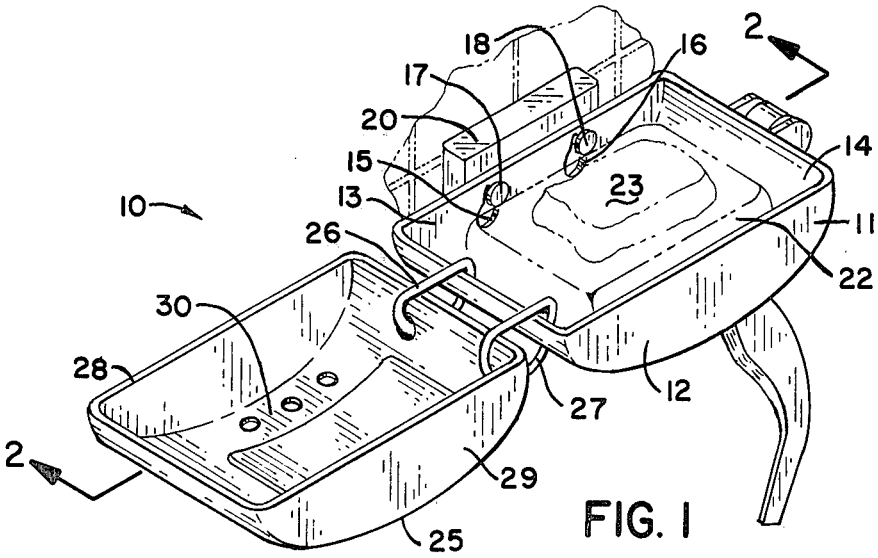
FIG. 1 is a front perspective view of the novel combined soap holder and press incorporating the present invention.

Referring to FIG. 1, the novel combined soap holder and press incorporating the present invention is indicated in the general direction of arrow 10 which comprises a base dish 11 having sidewalls 12 and 13 separated by a semi-circular bottom 14. The bottom 14 also includes upward ends which define the opposite ends of the dish 11. Sidewall 13 includes a pair of spaced apart openings 15 and 16 which serve as mounting holes for insertably receiving a pair of spaced apart pins 17 and 18 which are carried on a mounting block 20 suitably secured to the vertical base of a wall 21. The terminating ends of the pins 17 and 18 are enlarged so as to permit the pins to be introduced through a major diameter of the holes 15 and 16 and then moved to where the shank of the pins rest on a smaller diameter portion of the openings 15 and 16.

The base dish 11 is employed for holding or supporting a bar or cake of soap such as indicated by the numeral 22 which is disposed between the sidewalls 12 and 13 and rests on the bottom 14. A soap remnant is indicated by numeral 23 and is disposed on top of the cake or bar 22. The cake or bar of soap 22 may be a new bar or cake or it may be an older, used bar or cake of soap. However, it is the intent of the present invention that the remnant piece 23 be adhered to the bar or cake 22 so that a new and integral cake or bar is formed.

To achieve this end, a lid 25 is hingably carried on one end of the dish 11 by means of loops or rings 26 and 27 which pass through corresponding holes in the adjacent ends of the dish and lid respectively. It is to be noted that the diameter of the rings is fairly large so that a loose hinge relationship is provided between the dish and the lid so that no binding occurs and so that the lid may be readily positioned on top of the soap remnant 23 regardless of the size or bulk of the remnant. It is to be noted that the lid 25 corresponds substantially in shape and configuration to the dish 11 by having opposite sides 28 and 29 which are separated by a top piece 30 which also forms the opposite ends of the lid and provides the holes through which the rings 26 and 27 are disposed.

Figure 2:
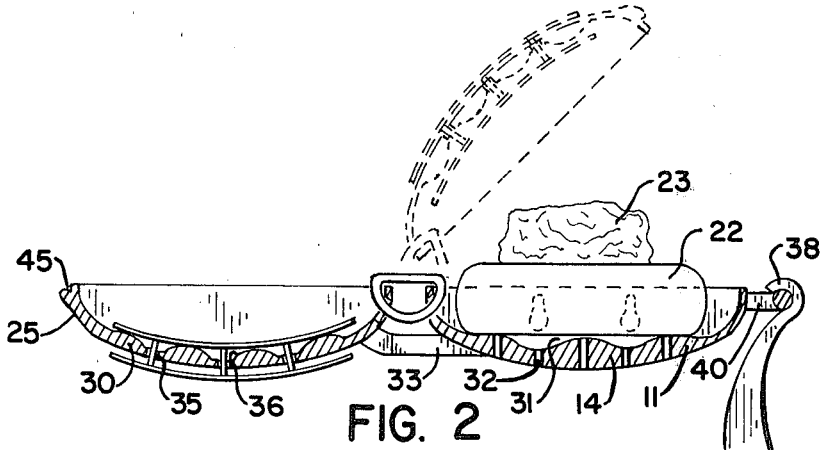
FIG. 2 is a longitudinal cross-sectional view of the combined soap holder and press shown in FIG. 1 as taken in the direction of arrows 2—2 thereof.

Referring now in detail to FIG. 2, it can be seen that the dish 11 includes an irregular contour on its bottom 14 which is indicated in general by the convolutions indicated by numeral 31. Such a configuration provides for collection areas for water or other liquid debris which may occur during the pressing of the remnant to the cake or bar. Also, drainage is provided by a plurality of holes such as hole 32 which permits the liquid residue to drain exteriorly of the dish 11.

FIG. 2 also illustrates that a selected end of the dish 11 includes a cantilevered arm 33 which outwardly projects beyond the periphery of the dish and serves as a support for the lid 25. When the lid is deployed in the manner shown in solid lines in FIG. 2, both the dish and the lid may be used to hold or support soap or other articles as desired by the user. The terminating end of arm 33 is indicated by numeral 34 in FIG. 3 and is contoured to the curvilinear configuration of the top 30 carried by the lid 25. The top 30 is provided with a series of drainage holes such as hole 35 and convolutions similar to the convolutions 31 carried on the dish 11 are also included and represented by the number 36. Therefore, any liquids may readily drain therethrough so as to keep the contents of the lid reasonably dry when the lid is used as a holder.

Figure 3:
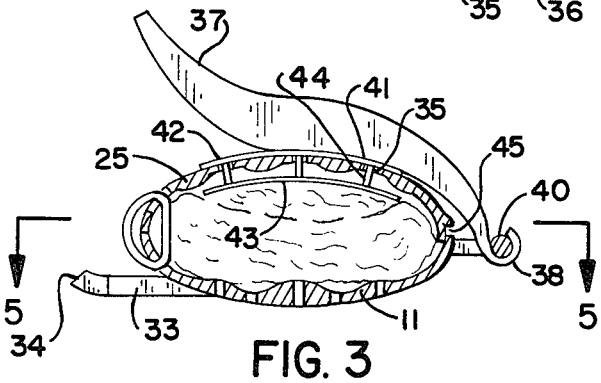
FIG. 3 is a view similar to the view of FIG. 2 illustrating the device as a press.

When it is desired to press the remnant 23 into the cake 22, the lid 25 is raised to the position shown in broken lines in FIG. 2 and subsequently lowered into the position shown in FIG. 3. A cam 37 includes a hooked end 38 which is mounted over a yoke 40 when not in use. However, to press the remnant 23 into the cake 22 via the lid 25, the cam 37 is removed from the yoke and reversed to the position shown in FIG. 3 so that the body 41 of the cam 37 comes into contact with a cam plate 42. As the end of the cam 37 is forcibly urged downward so as to pivot the cam about the yoke 40 via the hooked end 38, the body of the cam 41 is pressed against the cam plate 42 which, in turn, forcibly urges the lid 25 as well as a compression element 43 into forced engagement with the soap contained within the interior of the lid and dish. The element 43 is attached to the plate 42 by means of struts such as strut 44 which extends through the plurality of holes such as hole 35. After compression, the cam is removed from the yoke 40 and replaced in the position shown in FIG. 2 and the lid 25 is removed. Inasmuch as separation of the lid from the compressed soap may be difficult due to suction and adhesion, a lip 45 is provided on the lid to assist in lifting the lid from the pressed soap. Also, the cam plate 42 is jiggled and moved so that the element 43 tends to break any suction or adhesion of the soap with the lid.

Figure 4:
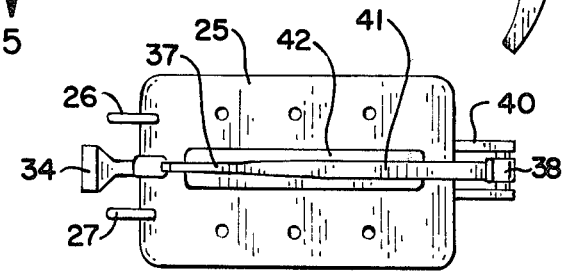
FIG. 4 is a top plan view of the device shown in FIG. 3.
Figure 5:
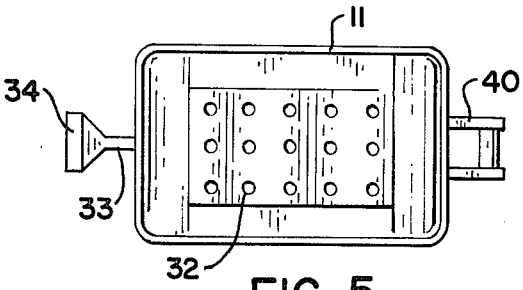
FIG. 5 is a cross-sectional view of the device shown in FIG. 3 as taken in the direction of arrows 5—5 thereof.

Referring now to FIG. 4, it can be seen that the body 41 of the cam 37 rides midway between the opposite sides of the cam plate 42 during the pressing procedure and the force is equally distributed radially through the lid 25. As shown in FIG. 5, a plurality of holes such as hole 32 are employed as drainage holes. Also, it can be seen that the yoke 40 and the arm 43 lie on the central longitudinal axis of the dish 11.

In view of the foregoing, it can be seen that the novel combined soap holder and press of the present invention provides a means for pressing soap remnants into a new bar or cake and that the means is also employed as a holder for supporting the integral bar once the pressing procedure has been completed. Drainage holes are provided in both the lid and the dish so that accumulation of water is eliminated. By employing the cam 37 and pivotally mounting the cam by means of its hooked end 38 with yoke 40, sufficient leverage is gained to press the lid downward into contact with the soap remnants for forcibly urging the remnants into cohesion with the soap cake or bar. Parting means such as the element 43 in combination with the cam plate 42 is employed for effecting removal of the soap bar from the lid. For effecting removal of the new cake or bar 22 from the dish 11, it is noted that the end of the cam 37 from its end formed in hook 38 is formed into a pointed end. This pointed end may be inserted into the openings 32 to break the suction therewith so that the integral soap cake can be readily removed. Also, the pointed end is employed for scoring or marking the top surface of the soap bar so that the surface is irregular and therefore, greater adhesion will occur with the soap remnants.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A combined soap holder and soap press for use in saving soap pieces by reforming remnants with a new soap bar comprising the combination of:

a base dish for holding a soap bar and remnants;

a lid hingably coupled to one end of said base dish;

cam means operably carried on said base dish for bearing against said lid to forcibly urge said lid to compress said soap bar and remnants together into a unity soap cake; and means carried on said end of said base dish hingably connected to said lid for supporting said lid in a side-by-side relationship with said base dish so as to serve as an additional holder when not in use as a soap press.

2. The invention as defined in claim 1 wherein:

said cam means includes a pivot carried on said base dish end opposite to its end hingably connected to said lid; and an elongated cam having an arcuate mid-section adapted to rollably engage with said lid during said pressing procedure.

3. The invention as defined in claim 2 wherein:

said lid includes parting means for forcibly urging said unity soap cake away from lid.

4. The invention as defined in claim 3 wherein:

said base dish includes a plurality of convolutions along its bottom and a plurality of drainage holes.

5. The invention as defined in claim 4 wherein:

said base dish includes means for removably supporting said dish on a vertical wall.

6. The invention as defined in claim 5 wherein:

said lid supporting means includes a rigid arm outwardly extending from said base dish.

7. The invention as defined in claim 6 wherein:

said hingable means mounting said lid on said base dish is a pair of oval shaped loops.

8. The invention as defined in claim 7 wherein:

said cam means further includes said cam having a hook provided on one of its opposite ends and a pointed configuration carried on its opposite end.

9. The invention as defined in claim 8 wherein:

said lid further includes a series of irregular convolutions provided along its interior surface cooperating with said parting means for breaking said soap cake away from said lid.

10. The invention as defined in claim 9 wherein:

said parting means includes a pair of strips on opposite sides of said lid and joined together by interconnecting pins so as to move back-and-fourth with respect to said lid.

* * * * *